US008091743B2

(12) United States Patent
Lester et al.

(10) Patent No.: US 8,091,743 B2
(45) Date of Patent: Jan. 10, 2012

(54) DISCHARGE DEVICE

(75) Inventors: Joseph Craig Lester, Liberty Township, OH (US); Julius Austria Coronel, Cincinnati, OH (US); Christopher Lawrence Smith, Liberty Township, OH (US)

(73) Assignee: The Procter & Gamble Compnay, Cincinnati, OH (US)

( * ) Notice: Subject to any disclaimer, the term of this patent is extended or adjusted under 35 U.S.C. 154(b) by 673 days.

(21) Appl. No.: 11/728,468

(22) Filed: Mar. 26, 2007

(65) Prior Publication Data

US 2008/0237274 A1 Oct. 2, 2008

(51) Int. Cl.
*B67D 3/00* (2006.01)

(52) U.S. Cl. ..... 222/518; 222/509; 222/511

(58) Field of Classification Search ..... 222/501, 222/509, 518, 511
See application file for complete search history.

(56) References Cited

U.S. PATENT DOCUMENTS 3,584,834 A * 6/1971 Reid et al. ..... 251/321
3,658,216 A 4/1972 Schwartzman
4,281,779 A 8/1981 Shepard
4,452,425 A * 6/1984 Lucking ..... 251/144
5,154,212 A 10/1992 Weber
5,447,257 A * 9/1995 Dark ..... 222/336
6,470,910 B2 * 10/2002 Blackbourn et al. ..... 137/588
6,742,680 B2 * 6/2004 Friedman ..... 222/509
6,896,158 B2 * 5/2005 Leray et al. ..... 222/145.1
7,140,520 B1 * 11/2006 Rutler ..... 222/511
D575,151 S * 8/2008 Smith et al. ..... D9/447
7,455,281 B2 * 11/2008 Craft ..... 251/335.2
7,513,395 B2 * 4/2009 Labinski et al. ..... 222/481.5

FOREIGN PATENT DOCUMENTS

WO WO 2006097704 A1 * 9/2006

* cited by examiner

*Primary Examiner* — Frederick C. Nicolas

(74) *Attorney, Agent, or Firm* — Julie A. McConihay; Leonard W. Lewis; Steven W. Miller

(57) ABSTRACT

A discharge device having a liquid outlet with a hollow interior. The valve system is located inside the hollow interior of the liquid inlet. The valve guide system has a valve guide and a first rib. The valve guide system has a valve guide having a valve guide width. The valve guide width is at less than about 1.15 mm. The first rib has a first rib width having a first rib width. The width of the first rib is less than about 2.5 mm wide.

6 Claims, 10 Drawing Sheets

DISCHARGE DEVICE

FIELD OF THE INVENTION

This invention relates to discharge devices.

BACKGROUND OF THE INVENTION

In the past decades research efforts have been directed towards the development of detergents which have an improved cleaning performance. Furthermore, the focus has been on developing detergent products which are highly viscous. It has recently been found that one of the main complaints of the users of detergent is that the products do not always dispense in a timely manner which add to the unpleasantness of washing clothes or doing laundry. It is desired to simplify this matter of dispensing the amount in the least amount of time.

Thus, it may be seen that measured dispensing which can be slow given that the liquid is typically viscous and convenient storage add to the complications of doing laundry. Accordingly, there is a need for a device which delivers a higher flow rate of liquid, especially for viscous liquids, during consumer use which results in shorter dosing time and less amount of time needed during laundry. This device would provide a more desirable consumer experience. Thus, a device, which solves or at least minimizes these problems, is highly desirable.

SUMMARY OF THE INVENTION

The present invention encompasses a discharge device having a liquid outlet with a hollow interior. The valve system is located inside the hollow interior of the liquid inlet. The valve guide system has a valve guide and a first rib. The valve guide system has a valve guide having a valve guide width. The valve guide width is at less than about 1.15 mm. The first rib has a first rib width having a first rib width. The width of the first rib is less than about 2.5 mm wide.

The figures herein are not necessarily drawn to scale.

DETAILED DESCRIPTION OF THE INVENTION

Section A will provide terms which will assist the reader in best understanding the features of the invention, but not to introduce limitations in the terms inconsistent with the context in which they are used in this specification. These definitions are not intended to be limiting. Section B will discuss the discharge device of the present invention. Section C will discuss examples of the present invention.

A. Terms

As used herein, the term "granules" and variants thereof mean any non-fluid composition.

As used herein, the term "fluids" and variants thereof mean any composition capable of wetting. The composition can include solids or gases in suitably subdivided form, but the overall composition excludes product forms which are substantially nonfluid overall, such as tablets or granules.

As used herein, the term "orifice" is the cross-section of the smallest perimeter of the liquid outlet.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

B. Package of the Present Invention

I. Discharge Device

Figure 1:
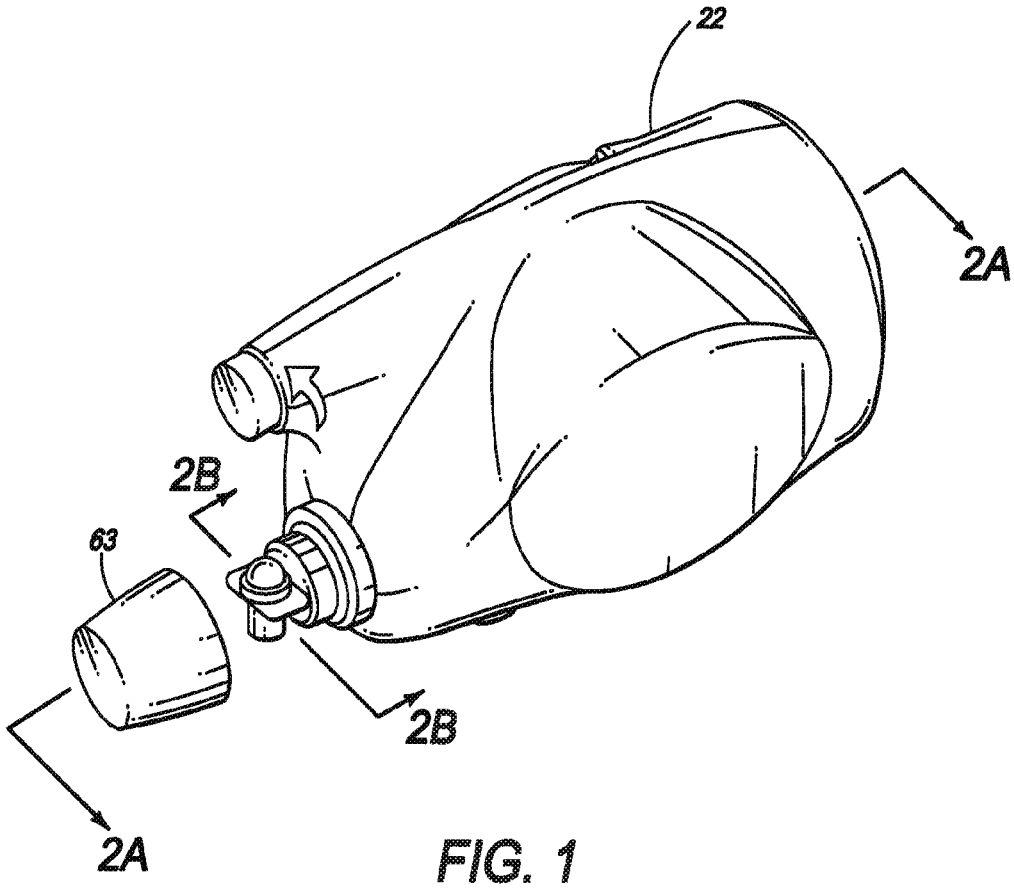
FIG. 1 is a perspective view of an embodiment of the discharge device of the present invention.
Figure 2A:
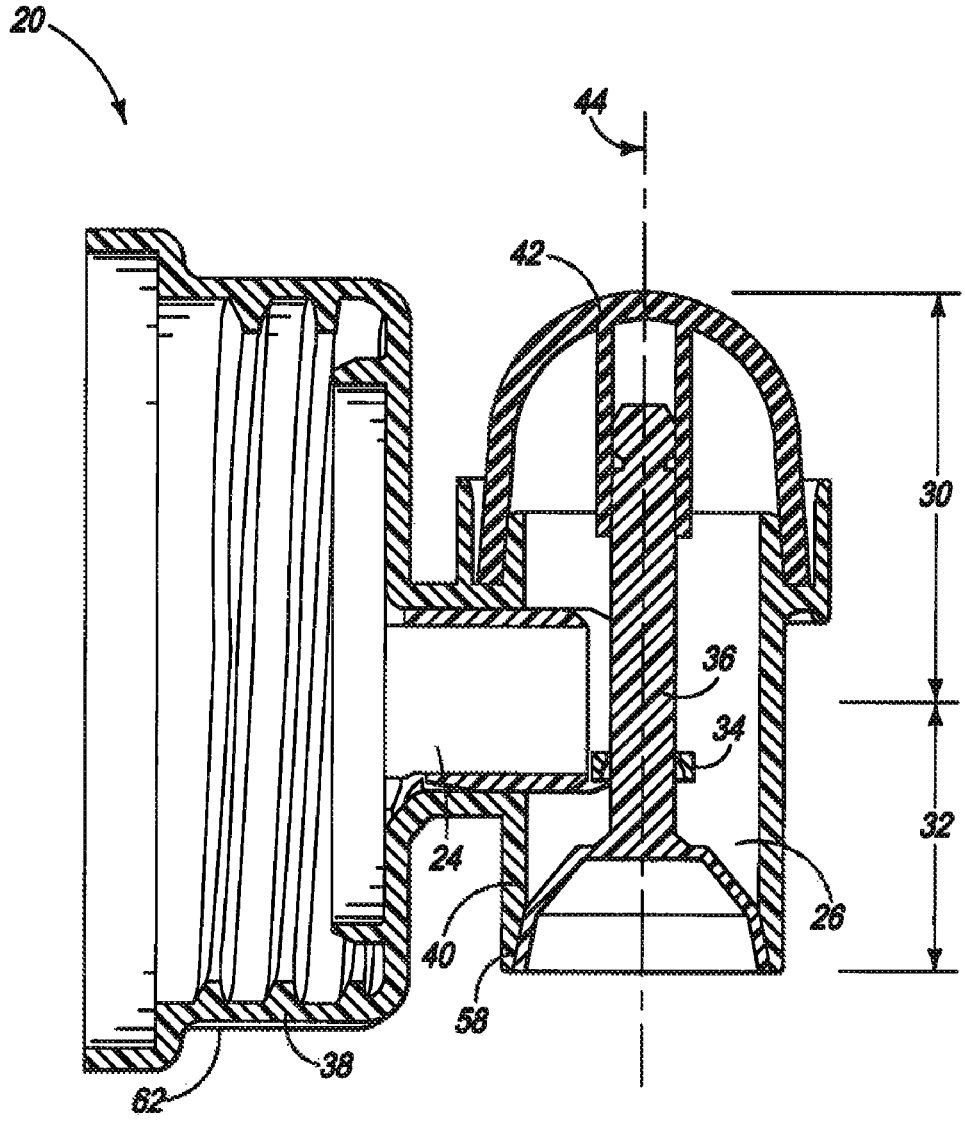
FIG. 2*a* is a cross-section view along line 2*a*-2*a* of the discharge device of FIG. 1.
Figure 2B:
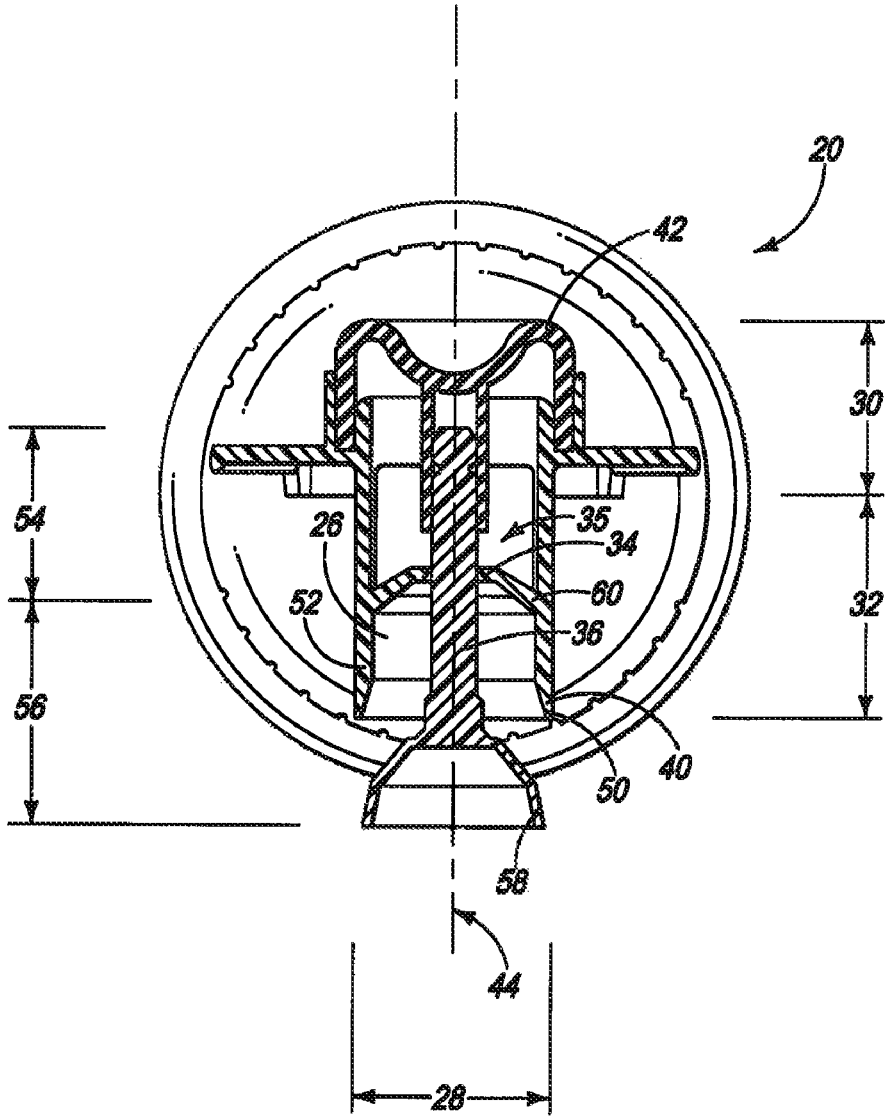
FIG. 2*b* is a cross-section view along line 2*b*-2*b* of the discharge device of FIG. 1 while the button is pressed.

Referring to FIG. 2*a* and FIG. 2*b*, the present invention relates to a discharge device 20 for dispensing liquids, especially viscous liquids from a container 22 (See FIG. 1). The discharge device 20 has a liquid inlet 24 and a liquid outlet 26. The liquid outlet 26 has an orifice 28, a first end 30, and a second end 32 opposite to the first end 30. The orifice 28 of the liquid outlet 26 contains a valve system 35 (see FIGS. 3-10*b*) and a stem 36 which passes through the valve guide 34. (see FIG. 2*a*-FIG. 10*c*)

Referring to FIG. 1, a discharge device 20 is shown which is designed to dispense liquids from containers 22. Generally, referring again to FIG. 2*a* and FIG. 2*b*, when the button 42 is unpressed, the stem 36 can seat in the walls 40 of the liquid outlet 26 and sealing bead 58 of the stem 36 is compressed against the walls 40 so that no liquid can flow from the container 22 (See FIG. 1) with which the discharge device 20 is used. Referring to FIG. 2*b*, when pressure is applied to the button 42, the stem 36 moves along the axis 44 to unseat the stem 36 from the outlet orifice 28 which may have conical seating 50 constituted by the walls 40. As a result, liquid flows along a liquid flow passageway around the stem 36 and through the valve system 35 (see FIGS. 3-10*b*) as shown by the arrows in FIG. 2*b*.

Referring to FIG. 1, using a discharge device 20 of this type avoids the problems caused by a number of soap containers, bleach containers, conditioner containers, and other containers around the laundry area. It also eliminates the need for lifting a gallon container or other heavy item for handling this matter by being able to discharge the liquid from any surface. Moreover, it also reduces the amount of time needed to discharge the liquid, simplifies the application of the right amount of the product at the right time, thereby reducing waste. For those without the strength to lift a heavy container, this discharge device 20 and container 22 keep the washing liquid readily available.

The discharge device 20 may be formed from any suitable material such as high-density polyethylene, low-density polyethylene, polypropylene or linear low-density polyethylene.

A. Liquid Inlet

Referring to FIG. 2*a*, generally, the liquid inlet 24 is provided to allow liquid to flow therethough from the container 22 (see FIG. 1).

The attachment 62 can be formed with screw threads 38 (See FIG. 2*a*) to allow attachment of the discharge device 20 to a container 22 (see FIG. 1). It will be appreciated that the discharge device 20 can be attached to a container 22 (see FIG. 1) in other ways but a connection which is not destroyed on removal of the discharge device 20 after emptying of the container 22 (see FIG. 1) may be preferred because it makes the discharge device 20 reusable. Other ways the attachment 62 can be used to attach the discharge device 20 and the container 22 are by pressure seal, an adhesive seal, a locking closure, a screw-type closure, a snap-fit closure, a heat seal, an ultrasonic seal, and/or a plug-seal and may optionally be air-tight and/or water-tight as desired for example, to prevent oxidation of the pourable product, absorption of moisture from the air, and/or water damage to the pourable product.

B. Liquid Outlet

Referring to FIG. 2*b*, the liquid outlet 26 is formed to allow liquid to flow there through from the container 22 and to provide a seal at the second end 32 of the liquid outlet 26 to prevent liquid from leaking. As stated above, the liquid outlet 26 has an orifice 28, a first end 30, and a second end 32 opposite to the first end 30. The liquid outlet 26 contains a valve guide 34 and a stem 36 which passes through the valve guide 34.

The walls 40 of the liquid outlet 26 can be any shape. In one non-limiting example, the walls 40 can be formed which have a complimentary shape to the stem 36. For example, in one-nonlimiting embodiment, the second end 56 of the stem 36 is conical and has a flared mouth, accordingly, the walls 40 of the liquid outlet 26 are formed with a conical shape.

i. Valve System

Referring to FIG. 3-FIG. 10*b*), the valve system 35 comprises of the valve guide 34 and the rib(s) 60. Both are described separately in detail below. The valve system 35 can be located anywhere along the liquid outlet 26. As seen in FIG. 2*a* and FIG. 2*b*, the valve system 35 can be in the path of the liquid flow passageway. In other words, the liquid is in contact with the valve system 35 when the button is depressed to release the liquid from the container 22.

Figure 2C:
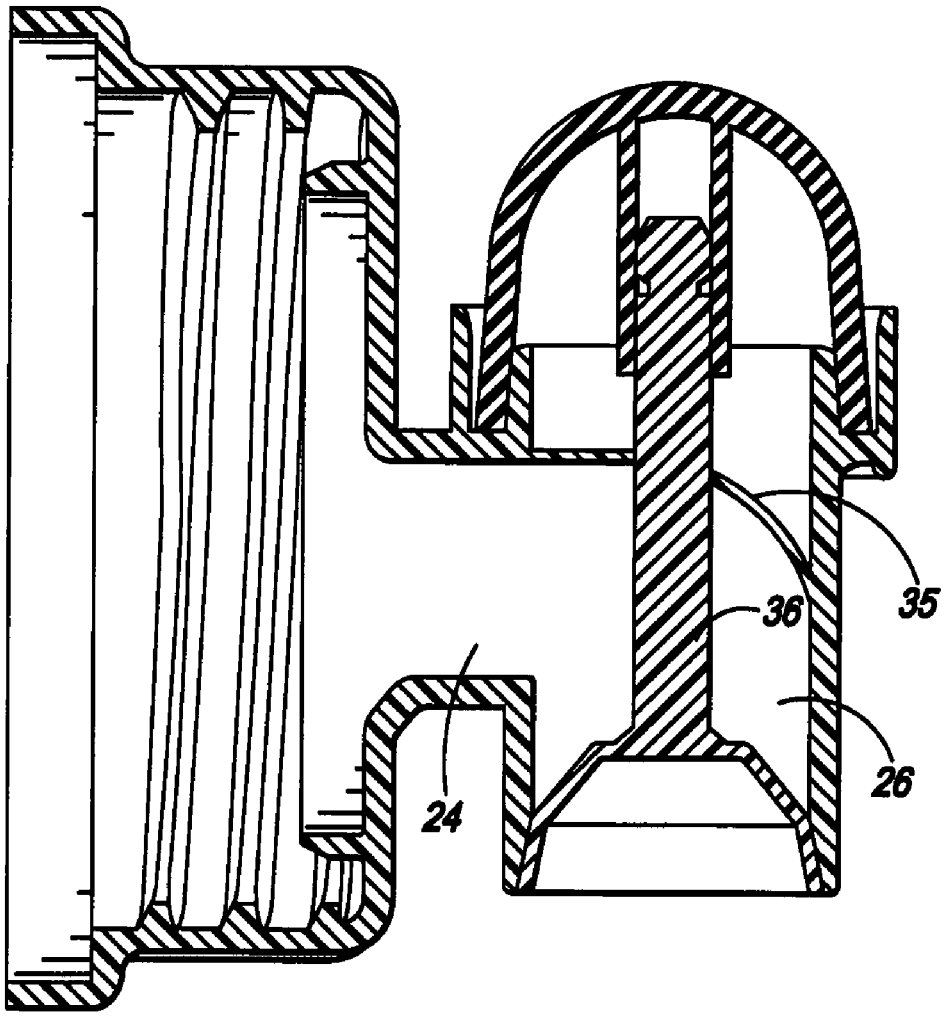
FIG. 2*c* is a cross-section view along line 2*a*-2*a* of an alternative embodiment of the discharge device.
Figure 3:
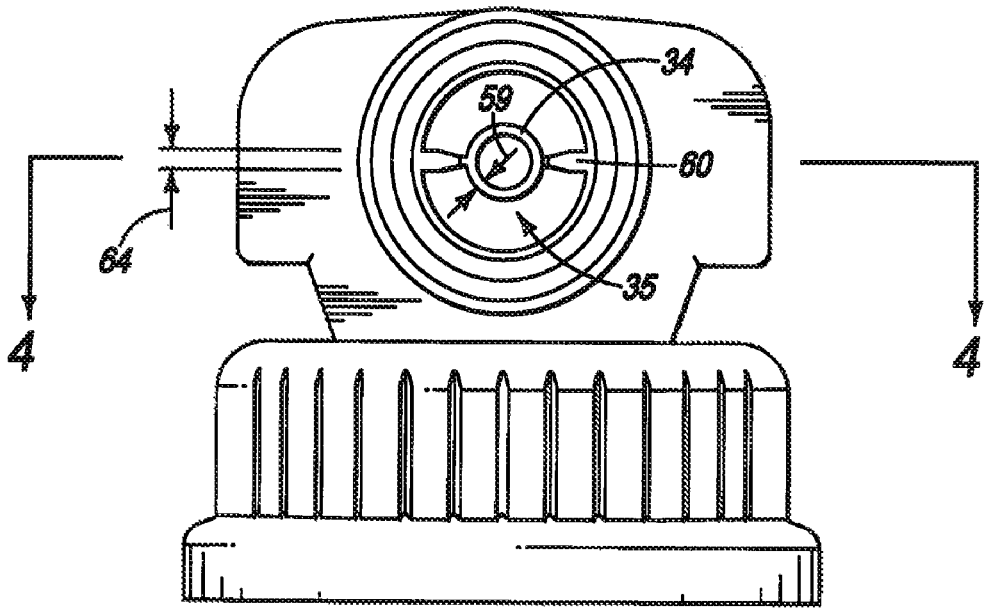
FIG. 3 is a front view of the discharge device.
Figure 4:
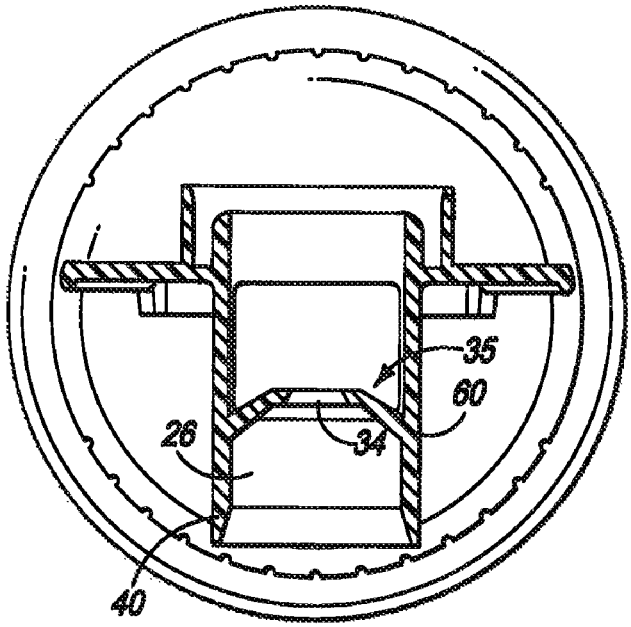
FIG. 4 is a cross-section view along line 4-4 of the discharge device of FIG. 3.
Figure 5:
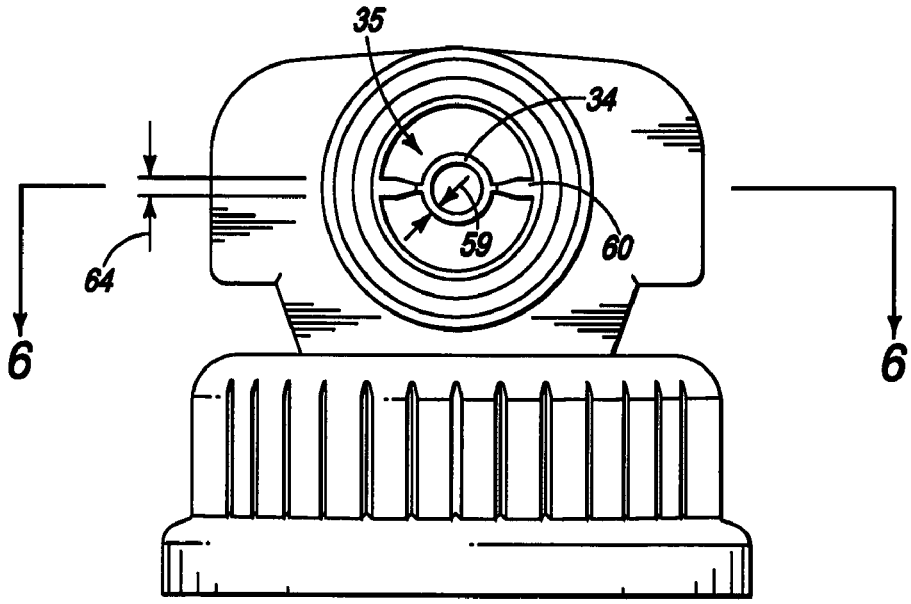
FIG. 5 is a front view of an alternative embodiment of the discharge device.
Figure 6:
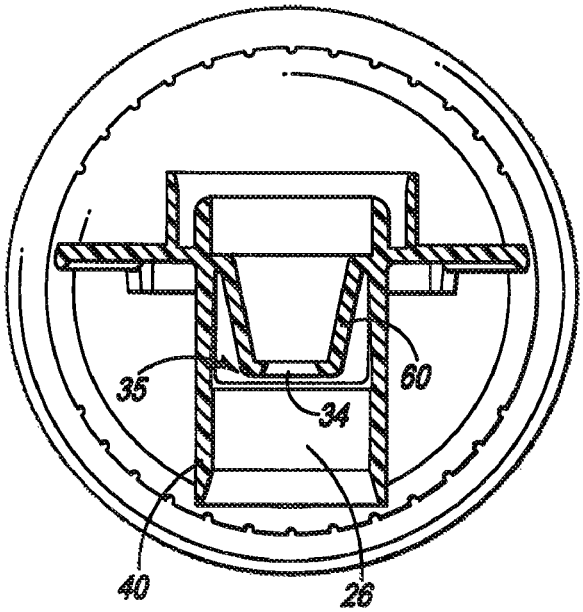
FIG. 6 is a cross-section view along line 6-6 of the alternative embodiment of the discharge device of FIG. 5.
Figure 7:
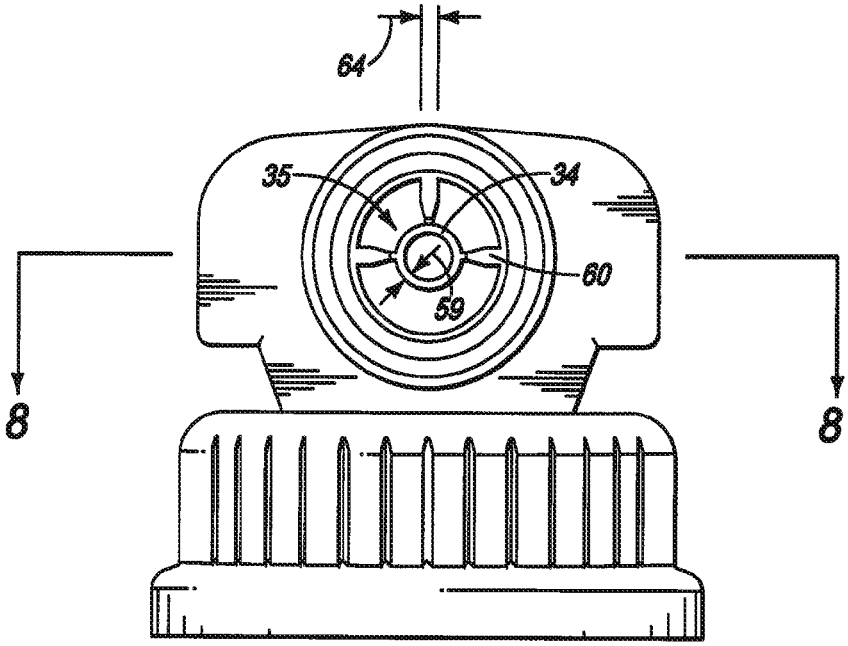
FIG. 7 is a front view of an alternative embodiment of the discharge device.

Alternatively, as seen in FIG. 2*c*, the valve system 35 can be constructed to not be in the path of the liquid flow passageway while the liquid is flowing from the liquid inlet 24 through the liquid outlet 26. In other words, the liquid is not in contact with the valve system 35 when the button is depressed to release the liquid from the container 22. In this embodiment, the valve system 35 is used as a guide for the stem 36 to provide stability, but allows for faster liquid flow because the there is not contact with the valve system 35.

a. Valve Guide

Referring to FIG. 3-FIG. 10*c*, valve guide 34 is secured to the walls 40 of the liquid outlet 26 by ribs 60. The valve guide 34 stabilizes the liquid flow profile and provides a maximum flow rate. Referring to FIG. 3-FIG. 10*c*, the higher flow rate is achieved by decreasing the surface area of the limiting flow passage, which is the valve system 35. To increase the flow through the valve system 35, the cross sectional area of the valve system 35 is reduced while still maintaining the valve system 35 structural performance. Generally, reducing the cross sectional area also decreases the width 59 of the valve guide and the width 64 of the ribs 60. Accordingly, reducing the width which is perpendicular to the flow of the liquid of the valve system 35 decreases drag on fluid passing through the liquid outlet 26.

Figure 10A:
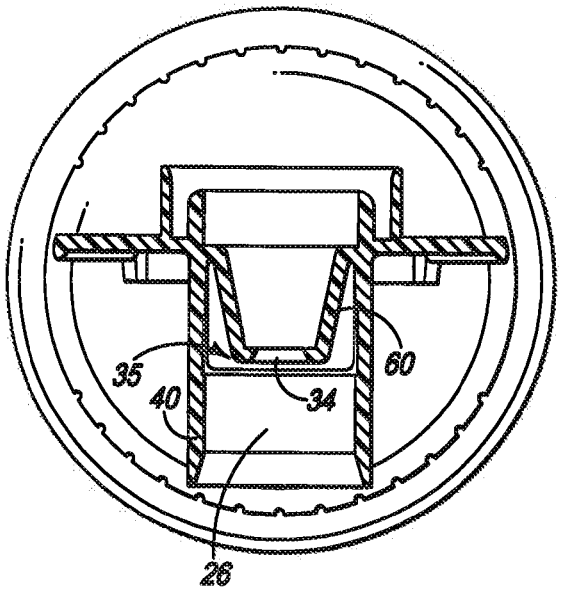
FIG. 10*a* is a cross-section view along line 10*a*-10*a* of the alternative embodiment of the discharge device of FIG. 9.
Figure 10B:
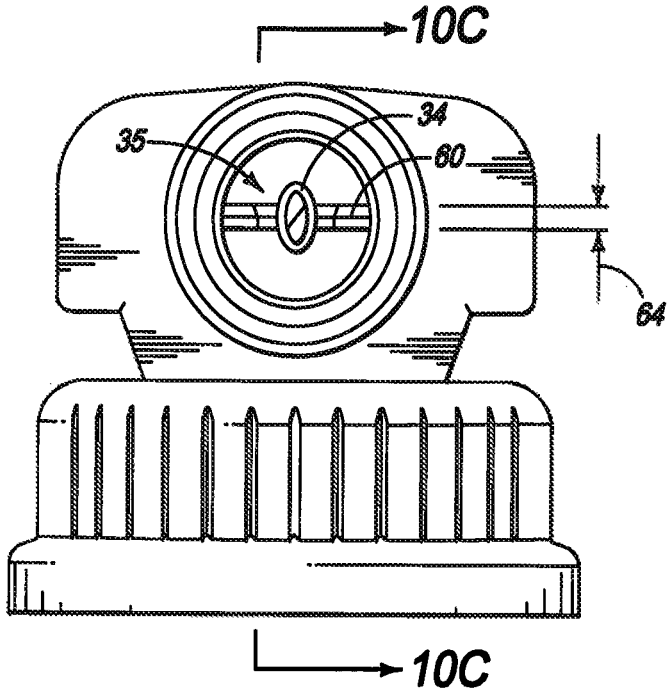
FIG. 10*b* is a front view of an alternative embodiment of the discharge device.
Figure 10C:
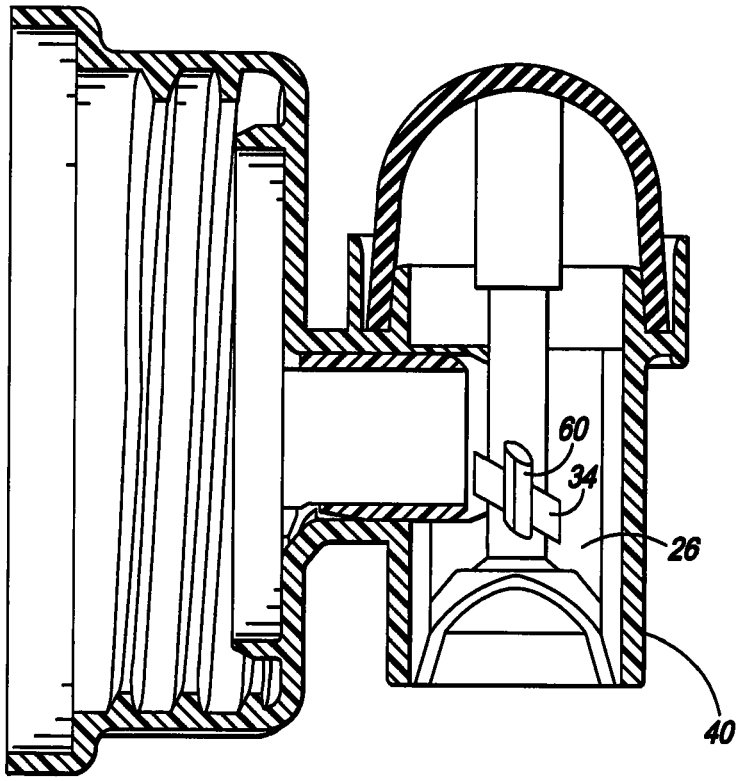
FIG. 10*c* is the cross-section view along line 10*c*-10*c* of the discharge device of 10*b*.
Figure 11:
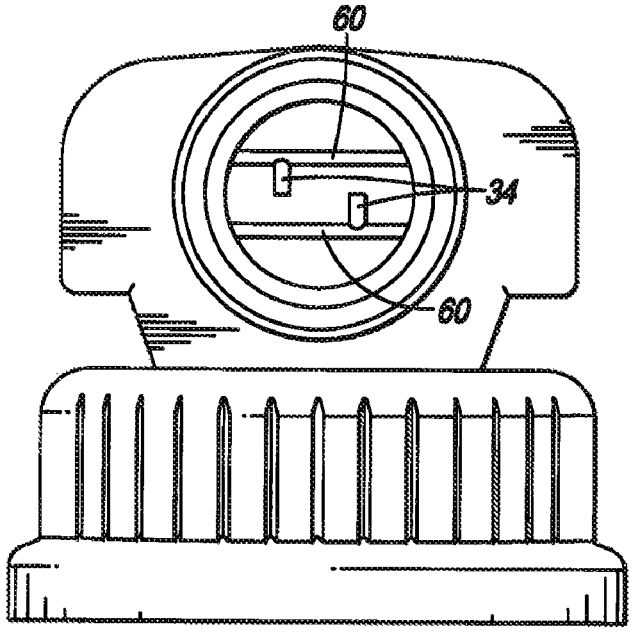
FIG. 11 is a front view of an alternative embodiment of the discharge device.
Figure 12:
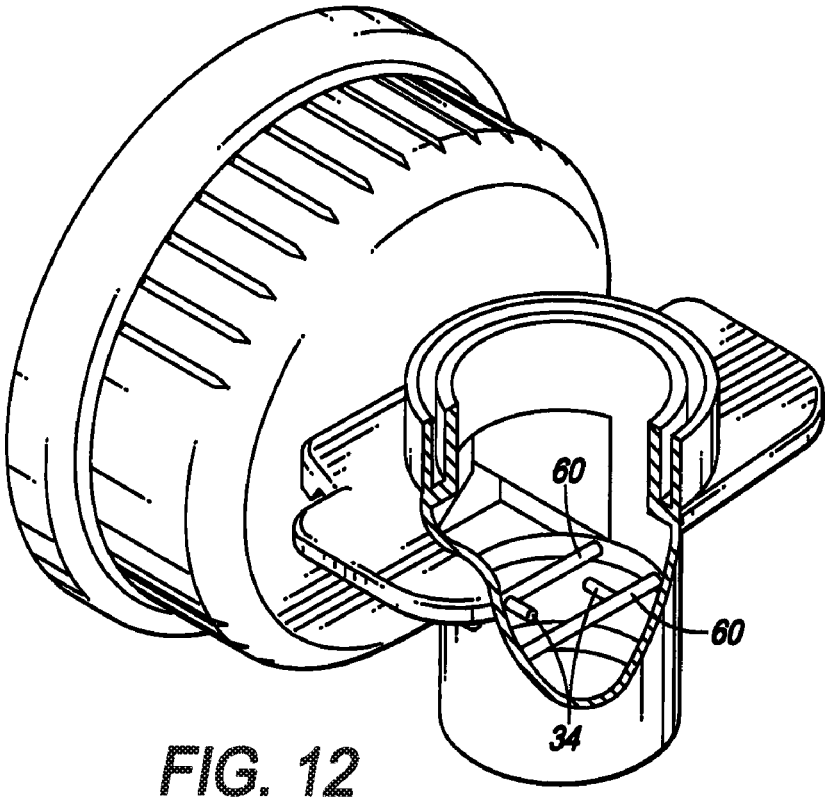
FIG. 12 is a perspective view of an alternative embodiment of the discharge device.

In addition, the valve guide 34 geometry can be changed to increase flow. Referring to FIG. 10*b*, the width 59 of the valve guide 34 is ovalized 61. The width 59 of the valve guide 34 is at least less than about 1.15 mm.

b. Ribs

Referring to FIGS. 3-10*c*, the ribs 60 connect the valve guide 34 to the walls 40 of the liquid outlet 26. The ribs 60 can be part of the walls 40 by molding or may be inserted by being bonded or spin welded. The width 64 of the ribs 60 is at least less than about 2.5 mms. The ribs 60 are reduced in width to decrease drag on fluid passing through (see FIGS. 3, 5, 7, 9, 10*b*) the liquid outlet 26.

Figure 8:
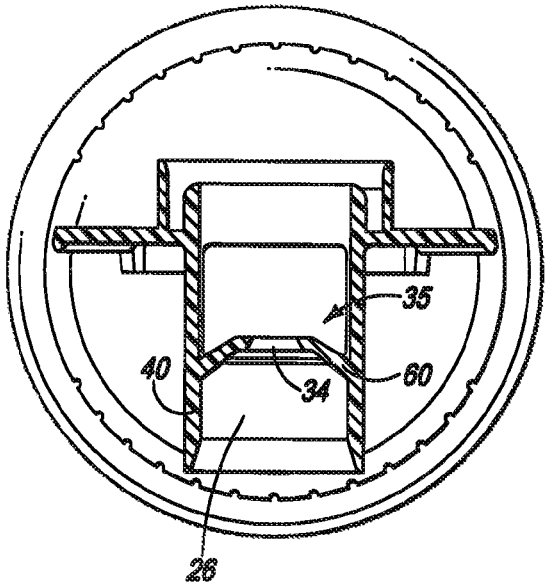
FIG. 8 is a cross-section view along line 8-8 of the alternative embodiment of the discharge device of FIG. 7.
Figure 9:
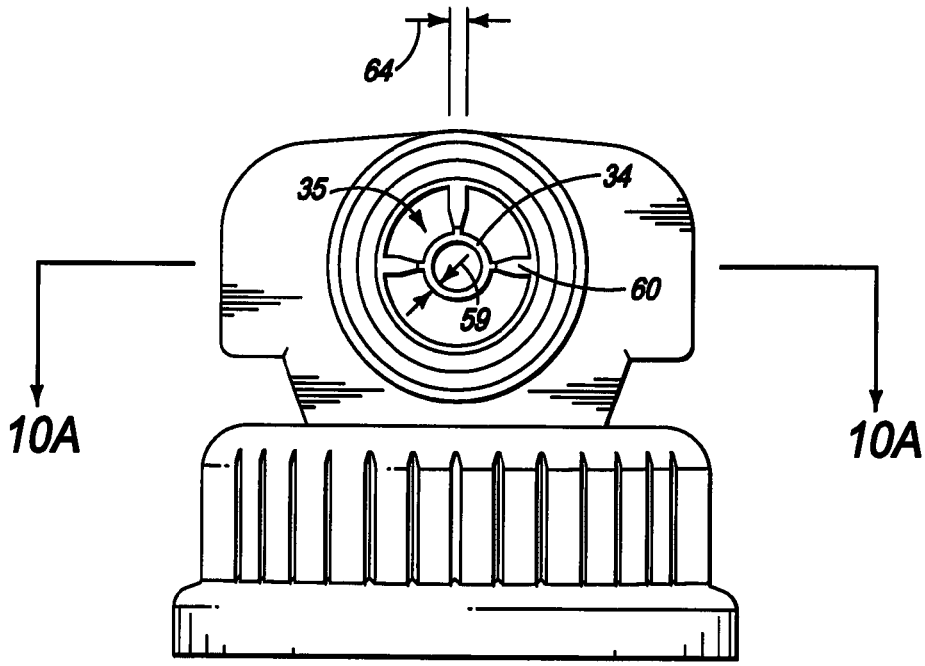
FIG. 9 is a front view of an alternative embodiment of the discharge device.

Referring to FIG. 4*a*, FIG. 6*a*, FIG. 8, and FIG. 10, in addition, the rib 60 geometry can be changed to increase flow and reduce surface contact of the liquid with the valve system 35. Referring to FIG. 4*a* and FIG. 8, the rib 60 may be angled upward where the valve guide 34 is in a plane above the rib 60. Referring to FIG. 10*a*, in another embodiment, the rib 60 may be angled downward or inverted where the valve guide 34 is in a plane below the rib 60.

ii. Stem

Referring to FIG. 2*a* and FIG. 2*b*, the stem 36 forms a connection between the button 42 and the liquid outlet 26. The stem 36 comprises a first end 54 and a second end 56 opposite to the first end 54. The first end 54 is adjacent to the button 42 and protrudes downwardly from the button 42. The stem 36 can have its first end 54 shown seated in the button 42 and the second end 56 on conical seating 50.

The second end 56 of the stem 36 seals the outlet 52 of the liquid outlet 26 and is the sealing for controlling the normal or repetitive opening of the discharge device 20. The second end 56 of the stem 36 can be conical and can be arranged to seat on the edge of a correspondingly tapered outlet 52 so as to close the outlet 52 of the liquid outlet 26. The outer edge of the external surface of the stem 36 is flush with the adjacent part of the second end 32 of the liquid outlet 26 when the discharge device 20 is closed so that there is virtually no space within which liquid can be retained by virtue of its surface tension. A sealing bead 58 can surround the stem 36 and ensure adequate contact pressure on the liquid outlet 26 at the outlet 52. The stem 36 can extend through a valve guide 34. Typically, the stem 36 extends the length of the liquid outlet 26. The length of the stem 36 can be any length which fits within the liquid outlet. In one alternative embodiment, the length of the stem 36 can be about 33 mms.

iii. Button

Referring to FIG. 2*a* and FIG. 2*b*, when the button 42 is depressed, liquid is released from the liquid outlet 26. Specifically, when the button 42 is depressed, the button 42 acts on the stem 36 movable in axis 44 so that outlet 52 is opened. The stem 36 is supported by the valve guide 34 and rib(s) 60. At the same time outlet 52 is opened and liquid is allowed to flow from the container 22 (see FIG. 1) through the liquid inlet 24 past the stem 36 and out of the liquid outlet 26. On release of the button 42, the outlet 52 is closed.

The button 42 can have a chamfered socket portion. The stem 36 can have its first end 54 shown seated in the button 42 and the second end 56 on conical seating 50. The second end 56 of the stem 36 seals the outlet 52 of the discharge device 20 and is the sealing for controlling the normal or repetitive opening of the discharge device 20.

The button 42 needs to be resilient but flexible so that it is capable of large deformation under manual pressure but subsequently resuming its original shape when the pressure is removed. The button 42 is suitably formed from an elastomeric polymer, for example ethylene vinyl acetate, metallocene polythene or polybutylene terephthlate.

iv. Calculation of the Ratio of the Area of the Orifice Compared to the Valve System The calculation of the ratio of the area of the orifice compared to the valve system is calculated by measuring the cross-sectional area, perpendicular to the flow of the liquid, of the valve system 35 and dividing this area by the area of the orifice 28.

For example, the area of the valve system is calculated as 53.9 square millimeter and the area of the orifice is calculated as 152.2 square millimeter. Thus, 53.9 divided by 152.2 is the ratio of 35.39%. Thus, the discharge device 20 can have ratio of the area of the orifice 28 to the area of the valve system 35 obstructed at less than about 35.39% in the direction of the liquid flow. The software he used to determine the area is Sold works 2007.

II. Container

Referring to FIG. 1, a discharge device 20 having a container 22 of sufficient size to rest on a shelf and sufficient length so that a dispensing mechanism is held conveniently for use provides the necessary solutions to the problems described above. The container 22 can rest on a shelf above the washer. The container 22 can be of sufficient size to hold a suitable amount of powder or liquid for washing purposes.

Preferably, the container 22 has a flat base so that the container 22 can rest easily on a shelf mounted adjacent to the clothes washer. The container 22, at least partially, overhangs a surface (e.g., shelf, washer, dryer). At the overhanging portion of the container 22, there is a discharge device 20. Because the container 22 can be taken down from the shelf, and placed on the washer or other surface to be filled, and the filling aperture in the top of the unit is large, it is easy to refill.

The discharge device 20 can fit a cup 63 marked for measuring the amount of liquid, which can be removably held therein. When it is desired to do laundry, it is possible to remove the cup 63 from the discharge device 20, place the cup beneath the discharge device 20, press the button 42 to open the outlet 52 of the liquid outlet 26, fill the cup 63 with the desired amount of liquid, close the outlet 52 (FIG. 2*b*) of the liquid outlet 26 by removing any force placed on the button 42 (FIG. 2*b*), and remove the cup 63 (FIG. 1) from beneath the discharge device 20. Then the content of the cup 63 (FIG. 1) can be added to the clothes washer in order to do the laundry. The cup 63 (FIG. 1) may be marked in Braille or levels for the amount of material necessary for each load or size of load of laundry. The cup 63 can also be marked to make it simpler for a person lacking laundry skills to determine how much of each laundry material is to be used. In this fashion, the laundry process may be more simply accomplished.

Referring to FIG. 1, as stated above, the container 22 is attached to the discharge device 20. The container material can be any material. It is possible to make the container 22 of a clear plastic so that it can be easily determined when the liquid contained therein is running low, and when the container 22 needs to be refilled. The container 22 may be made of transparent material, translucent material, opaque material or any reasonable combination thereof. The only requirement is that the material be inert to the laundry agent contained therein. Clear bottle materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The transparent container 22 according to the invention preferably has a transmittance of more than 25%, more preferably more than 30%, more preferably more than 40%, more preferably more than 50% in the visible part of the spectrum (approx. 410-800 nm). Alternatively, absorbency of the container 22 may be measured as less than 0.6 or by having transmittance greater than 25% wherein % transmittance equals: 110 absorbancy×100%. For purposes of the invention, as long as one wavelength in the visible light range has greater than 25% transmittance, it is considered to be transparent/translucent. Enzyme deactivation as a result of UV-damage may occur at very low transmission of UV-B radiation through the container wall.

III. Liquid

A plurality of laundry agents may be used, kept handy for use and dispensed easily. The laundry agent may be in liquid form, in powdered form, or in another suitable form.

C. Examples

Examples of the invention are set forth hereinafter by way of illustration and are not intended to be in any way limiting of the invention. The examples are not to be construed as limitations of the present invention since many variations thereof are possible without departing from its spirit and scope.

Example I

A liquid outlet with a hollow interior wherein a valve system is located inside the hollow interior of the liquid inlet. The valve system comprises a valve guide and 2 ribs. The valve guide width is 0.075 mms wide. Each rib has a width is 1.55 mms wide.

Example II

A liquid outlet with a hollow interior wherein a valve system is located inside the hollow interior of the liquid inlet. The valve system comprises a valve guide and 3 ribs. The valve guide width is 0.075 mms wide. Each rib has a width is 1.55 mms wide.

Example III

A liquid outlet with a hollow interior wherein a valve system is located inside the hollow interior of the liquid inlet. The valve system comprises a valve guide and 1 rib. The valve guide width is 075 mms wide. Each rib has a width is 1.55 mms wide.

Example IV

A liquid outlet with a hollow interior wherein a valve system is located inside the hollow interior of the liquid inlet. The valve system comprises a valve guide and 2 ribs. The valve guide has widths. The first width is 1.0 mm wide. The second width is 1.2 mm wide. Each rib has two widths. The first width is 1.0 mm wide. The second width is 1.2 mm wide.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A discharge device comprising a liquid outlet with a hollow interior wherein a valve system is located inside said hollow interior of said liquid outlet, wherein said valve system comprises i. a valve guide comprising a first valve guide width and a second valve guide width, wherein said first valve guide width is less than about 1.15 mm and said second valve guide width is less than about 1.0 mm; and ii. a first rib which has a first rib width and a second rib width, wherein said first rib width is less than about 2.5 mm wide and said second rib width is less than about 1.6 mm.

2. The discharge device according to claim 1, further comprising a second rib.

3. The discharge device according to claim 2, further comprising a third rib.

4. A discharge device comprising a liquid outlet with a hollow interior wherein a valve system is located inside said hollow interior of said liquid outlet, wherein said valve system comprises i. a valve guide comprising a first valve guide width, wherein said first valve guide width is at least about 1.15 mm wide and ii. a first rib, wherein said valve guide further comprises a second width wherein said second width is less than about 2.3 mm.

5. The discharge device according to claim 4, further comprising a second rib.

6. The discharge device according to claim 5, further comprising a third rib.

* * * * *